US010260467B2

(12) United States Patent
Ezaki et al.

(10) Patent No.: US 10,260,467 B2
(45) Date of Patent: Apr. 16, 2019

(54) FUEL INJECTION VALVE

(71) Applicant: DENSO CORPORATION, Kariya, Aichi-pref. (JP)

(72) Inventors: Ryuichi Ezaki, Kariya (JP); Naofumi Adachi, Kariya (JP)

(73) Assignee: DENSO CORPORATION, Kariya (JP)

( * ) Notice: Subject to any disclaimer, the term of this patent is extended or adjusted under 35 U.S.C. 154(b) by 91 days.

(21) Appl. No.: 15/190,545

(22) Filed: Jun. 23, 2016

(65) Prior Publication Data

US 2017/0002782 A1 Jan. 5, 2017

(30) Foreign Application Priority Data

Jul. 2, 2015 (JP) ..... 2015-133663

(51) Int. Cl.
*F02M 47/02* (2006.01)
*F02M 63/00* (2006.01)
*F02M 51/06* (2006.01)

(52) U.S. Cl.
CPC ..... *F02M 47/027* (2013.01); *F02M 63/0077* (2013.01); *F02M 51/0653* (2013.01); *F02M 2200/28* (2013.01)

(58) Field of Classification Search
CPC ..... F02M 47/027; F02M 63/0077; F02M 51/0653; F02M 2200/28
USPC ..... 239/584
See application file for complete search history.

(56) References Cited

U.S. PATENT DOCUMENTS 4,856,713 A * 8/1989 Burnett ..... F02M 43/04 123/23
5,094,215 A * 3/1992 Gustafson ..... F02M 57/024 123/447
5,125,575 A * 6/1992 Iwanaga ..... F02M 47/027 239/585.3
5,139,042 A * 8/1992 Calhoun ..... F16K 21/18 137/15.17
5,671,715 A * 9/1997 Tsuzuki ..... F02M 47/027 123/467
5,694,903 A * 12/1997 Ganser ..... F02M 45/12 123/467
5,839,661 A 11/1998 Iwanaga
6,027,037 A 2/2000 Murakami et al.
(Continued)

FOREIGN PATENT DOCUMENTS

JP 4-94448 3/1992
JP 7-293387 11/1995
(Continued)

*Primary Examiner* — Chee-Chong Lee
(74) *Attorney, Agent, or Firm* — Nixon & Vanderhye P.C.

(57) ABSTRACT

A fuel injection valve includes a nozzle needle that opens or closes an injection hole communicating with an internal combustion engine, and a high-pressure fuel is introduced into a control room to urge the nozzle needle to close the injection hole. An orifice body includes a discharge passage through which the fuel is discharged from the control room to a low pressure portion, and an orifice-body sheet surface that is flat and surrounds a downstream end part of the discharge passage. A valve body contacts with or separates from the orifice-body sheet surface to close or open the discharge passage. A chamfered part is provided on a corner part in which the orifice-body sheet surface intersects with the discharge passage.

16 Claims, 4 Drawing Sheets

(56) References Cited

U.S. PATENT DOCUMENTS

| | | | | |
|---|---|---|---|---|
| 6,035,532 | A * | 3/2000 | Earnhardt | F02M 51/0614 29/888.44 |
| 6,213,098 | B1 * | 4/2001 | Kato | F02M 45/08 123/300 |
| 6,339,877 | B1 * | 1/2002 | Straub | B23P 6/00 29/557 |
| 2010/0116910 | A1 | 5/2010 | Girlinger et al. | |

FOREIGN PATENT DOCUMENTS

| | | | | |
|---|---|---|---|---|
| WO | WO 2013/045690 | A1 | 4/2013 | |
| WO | WO2013045690 | * | 4/2013 | F02M 63/00 |

* cited by examiner

FUEL INJECTION VALVE

CROSS REFERENCE TO RELATED APPLICATION

This application is based on and incorporates herein by reference Japanese Patent Application No. 2015-133663 filed on Jul. 2, 2015.

TECHNICAL FIELD

The present disclosure relates to a fuel injection valve that injects fuel into an internal combustion engine.

BACKGROUND

A conventional fuel injection valve includes a nozzle needle that opens or closes an injection hole through which a fuel is injected into an internal combustion engine, a control room into which a high-pressure fuel is introduced to urge the nozzle needle in a valve closing direction, an orifice body having a discharge passage through which the fuel in the control room is discharged to a low pressure portion, and a valve body that opens or closes the discharge passage by contacting with or separating from a flat sheet surface formed on the orifice body.

Upon opening of the discharge passage, the high-pressure fuel in the control room is released to the low pressure portion through the discharge passage. Accordingly, a pressure in the control room decreases, and the nozzle needle is driven to move in a valve opening direction, thereby opening the injection hole (refer to JP H10-153155 A corresponding to U.S. Pat. Nos. 5,839,661, 6,027,037, for example).

Fuel containing various foreign objects, i.e. low-quality fuel is anticipated to be widely used. When a foreign object of the fuel is stuck between the valve body and the sheet surface in vicinity of a corner part (i.e. outlet edge part) in which the sheet surface intersects with the discharge passage, the corner part escapes toward the discharge passage easily, i.e. deforms easily. Accordingly, a crack is likely to be generated in the corner part. Subsequently, damage of the sheet surface may progress from the crack of the corner part by fluid abrasive action of fine foreign objects contained in the fuel discharged through the discharge passage to the low pressure portion.

As a result, even when the valve body is in contact with the sheet surface, and the discharge passage is closed, the high-pressure fuel may leak through the damaged part of the sheet surface to the low pressure portion. Hence, a fuel injection amount and a fuel leakage amount may increase.

SUMMARY

It is an objective of the present disclosure to limit generation of a crack caused by foreign objects stuck in a fuel injection valve.

According to an aspect of the present disclosure, a fuel injection valve includes a nozzle needle, a control room, an orifice body, a valve body, and a chamfered part. The nozzle needle opens or closes an injection hole through which a fuel is injected into an internal combustion engine. A high-pressure fuel is introduced into the control room to urge the nozzle needle in a valve closing direction. The orifice body includes a discharge passage through which the fuel is discharged from the control room to a low pressure portion, and an orifice-body sheet surface that is flat and surrounds a downstream end part of the discharge passage. The valve body contacts with or separates from the orifice-body sheet surface to close or open the discharge passage. The chamfered part is provided on a corner part in which the orifice-body sheet surface intersects with the discharge passage.

The chamfered part is provided in the corner part where the orifice-body sheet surface intersects with the discharge passage. Hence, the corner part is unlikely to be deformed toward the discharge passage even when a foreign object is stuck between the valve body and the orifice-body sheet surface in vicinity of the corner part. Therefore, generation of crack can be restricted.

Furthermore, if the chamfered part is not provided in the corner part where the orifice-body sheet surface intersects with the discharge passage, a flow direction of the fuel discharged through the discharge passage to the low pressure portion is drastically changed in vicinity of the corner part. Hence, fluid abrasive action force becomes large. On the other hand, when the chamfered part is provided in the corner part where the orifice-body sheet surface intersects with the discharge passage, a flow direction of the discharged fuel is changed moderately. Therefore, the fluid abrasive action force can be reduced.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
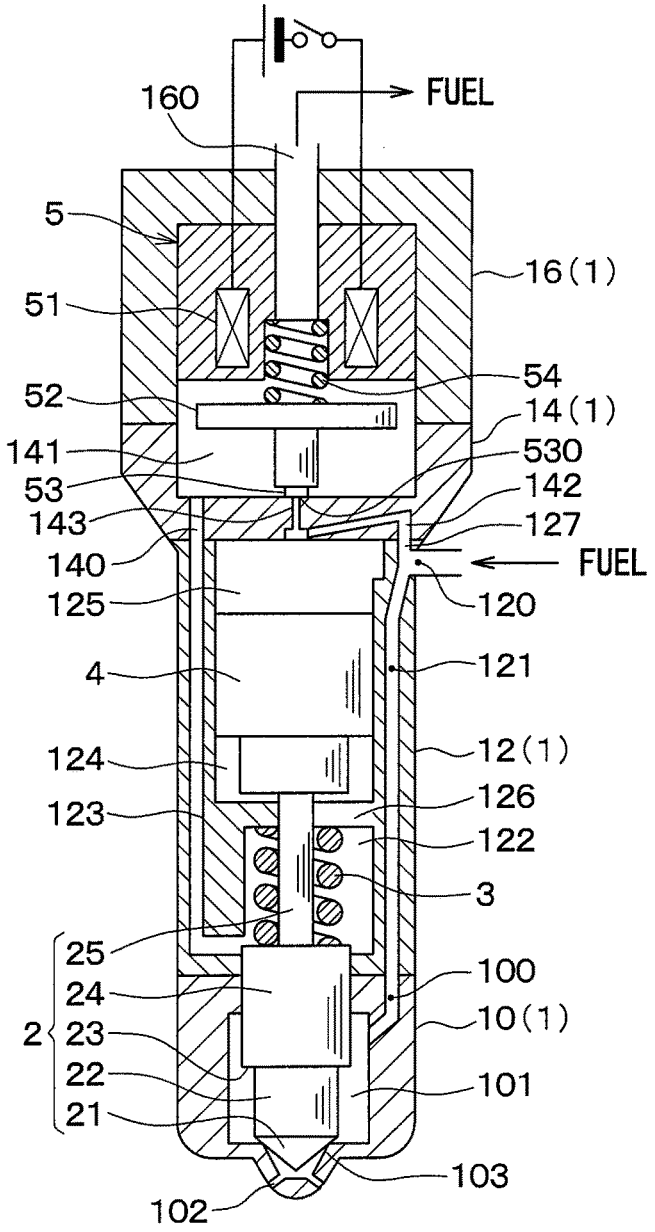
FIG. 1 is a schematic sectional diagram showing a fuel injection valve according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described below. A fuel injection valve according to the present embodiment is attached to a cylinder head of an internal combustion engine (e.g., a compression ignition internal combustion engine). The fuel injection valve injects a high-pressure fuel accumulated in a common rail into a combustion chamber of the internal combustion engine.

As shown in FIG. 1, a body 1 of the fuel injection valve is an integrated body including a nozzle body 10, a lower body 12, an orifice body 14 and an upper body 16.

The lower body 12 includes an inflow port 120 through which the high-pressure fuel supplied from the common rail is introduced into the body 1 as shown by an arrow in FIG. 1. The inflow port 120 communicates with a fuel accumulation room 101 provided in the nozzle body 10 through a high-pressure fuel passage 121 provided in the lower body 12 and a high-pressure fuel passage 100 provided in the nozzle body 10.

The nozzle body 10 includes an injection hole 102 through which the high-pressure fuel introduced into the fuel accumulation room 101 is injected into the combustion chamber of the internal combustion engine, and a nozzle-body sheet portion 103 that has a tapered shape and is provided on an upstream side of the injection hole 102 in a flow direction of the fuel.

A nozzle needle 2 having a step cylinder shape is disposed inside the nozzle body 10 and the lower body 12.

The nozzle needle 2 includes a nozzle-needle sheet portion 21 having a tapered shape, a small-diameter cylindrical portion 22, a pressure receiving portion 23, a large-diameter cylindrical portion 24 and a pin portion 25, which are arranged in this order in a direction away from the injection hole 102, as shown in FIG. 1.

The large-diameter cylindrical portion 24 of the nozzle needle 2 is supported by the nozzle body 10 and the lower body 12 slidably and liquid-tightly.

The nozzle-needle sheet portion 21, the small-diameter cylindrical portion 22 and the pressure receiving portion 23 are arranged in the fuel accumulation room 101.

The pin portion 25 is arranged in a spring room 122 provided in the lower body 12. An end part of the pin portion 25 is located in a low pressure room 124, and an end surface of the end part of the pin portion 25 is in contact with a command piston 4.

The spring room 122 is connected to a fuel tank through a low pressure passage 123 provided in the lower body 12, a low-pressure fuel passage 140 provided in the orifice body 14, an actuator room 141 (low pressure portion) defined by the orifice body 14 and the upper body 16, and an outflow port 160 provided in the upper body 16.

The injection hole 102 is opened or closed by separation or contact of the nozzle-needle sheet portion 21 from or with the nozzle-body sheet portion 103. Pressure of the high-pressure fuel in the fuel accumulation room 101 is applied on the pressure receiving portion 23, and accordingly the nozzle needle 2 is urged in a valve opening direction to open the injection hole 102. The nozzle needle 2 is urged in a valve closing direction to close the injection hole 102 by a nozzle spring 3 disposed in the spring room 122.

The lower body 12 includes the low pressure room 124 and a control room 125 which are separated by the command piston 4 having a step cylindrical shape.

The low pressure room 124 is connected to the spring room 122 through a gap between a partition wall 126 of the lower body 12 and the pin portion 25.

The control room 125 is connected to the inflow port 120 through an introduction passage 127 provided in the lower body 12 and an introduction passage 142 provided in the orifice body 14. Thus, the high-pressure fuel is supplied from the common rail to the control room 125 through the introduction passages 127 and 142. The command piston 4 is subjected to a pressure of the high-pressure fuel introduced into the control room 125 and urges the nozzle needle 2 in the valve closing direction.

The control room 125 is connected to the actuator room 141 through a discharge passage 143 provided in the orifice body 14. The high-pressure fuel in the control room 125 is discharged to the actuator room 141 through the discharge passage 143. The discharge passage 143 is a cylindrical space having an even diameter.

Figure 4:
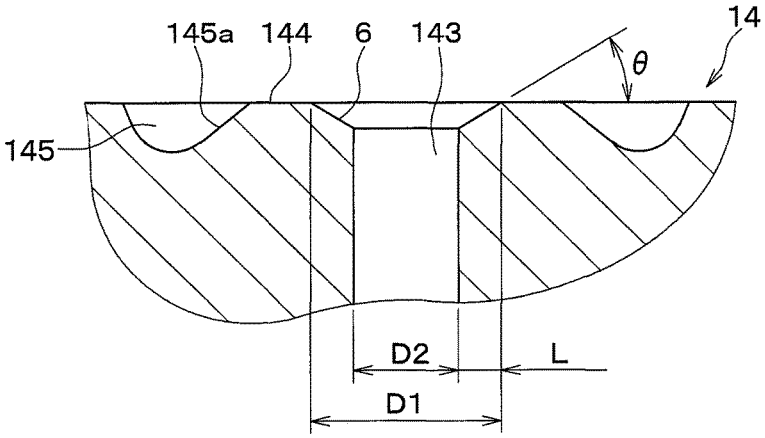
FIG. 4 is a sectional diagram showing a state of the orifice body after polishing, according to the first embodiment.

As shown in FIGS. 1 and 4, the orifice body 14 includes an orifice-body sheet surface 144 that is flat. A valve body 53 contacts or separates from the orifice-body sheet surface 144. The orifice body 14 includes an orifice-body recess portion 145 having an annular shape and surrounding the orifice-body sheet surface 144. The orifice-body recess portion 145 may surround the orifice-body sheet surface 144 continuously and entirely. The orifice-body sheet surface 144 is a flat surface perpendicular to an axis line of the discharge passage 143. The orifice-body sheet surface 144 surrounds an end part of the discharge passage 143 adjacent to the actuator room 141. In other words, the orifice-body sheet surface 144 surrounds a downstream end part of the discharge passage 143. The orifice-body sheet surface 144 may surround the end part of the discharge passage 143 continuously and entirely.

An electromagnetic control valve 5 is disposed in the actuator room 141. The control valve 5 includes a solenoid 51 that generates a magnetic attraction force upon energization, an armature 52 attracted by the magnetic attraction force, the valve body 53 that is joined to the armature 52 and opens or closes the discharge passage 143 in accordance with separation or contact of a flat valve-body sheet surface 530 of the valve body 53 from or with the orifice-body sheet surface 144, and a valve spring 54 urging the armature 52. The valve-body sheet surface 530 may be perpendicular to an axial direction of the discharge passage 143.

The armature 52 and the valve body 53 are attracted by the solenoid 51 in a direction away from the orifice-body sheet surface 144, and urged by the valve spring 54 toward the orifice-body sheet surface 144.

Figure 2:
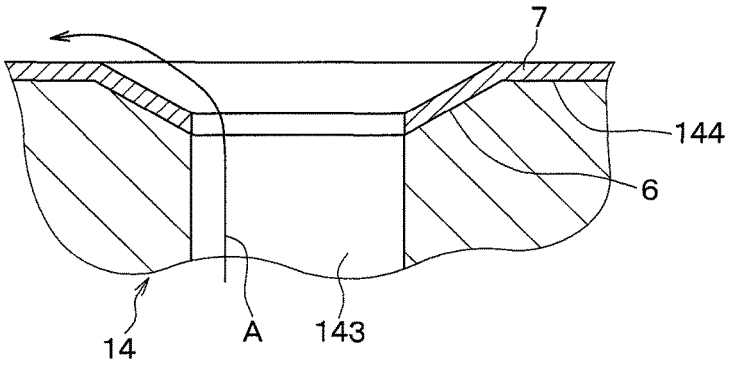
FIG. 2 is a sectional diagram showing an orifice body after coating thereon, according to the first embodiment.

As shown in FIGS. 2 and 4, in the orifice body 14, a corner part on which the orifice-body sheet surface 144 intersects with the discharge passage 143 has been chamfered and includes a chamfered part 6. The orifice-body sheet surface 144 and the chamfered part 6 are coated and improved in abrasion resistance. Thus, a coating layer 7 (coating) has been formed on the orifice-body sheet surface 144 and the chamfered part 6. The orifice body 14 is made of stainless steel. The coating layer 7 is made of chromium nitride superior to the stainless steel in abrasion resistance. The chamfered part 6 may be a surface connecting the orifice-body sheet surface 144 and an inner surface of the discharge passage 143. The chamfered part 6 may surround the end part of the discharge passage 143 continuously and entirely.

Figure 3:
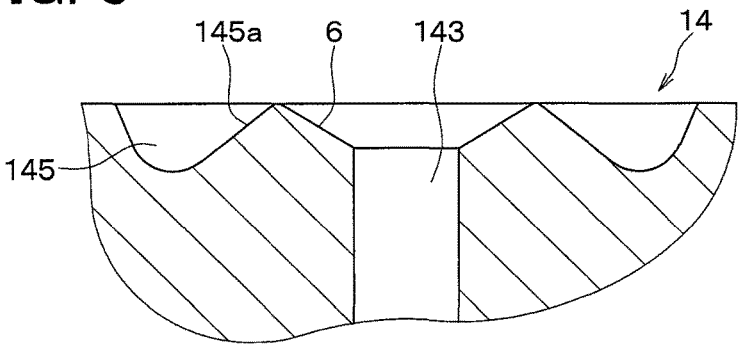
FIG. 3 is a sectional diagram showing a state of the orifice body before polishing, according to the first embodiment.

Next, detailed configurations and processing procedures of the orifice body 14 will be described. First, as shown in FIG. 3, the discharge passage 143, the orifice-body recess portion 145 and the chamfered part 6 are formed by cutting, electric spark machining or pressing of the orifice body 14, for example. At this step, the orifice-body sheet surface 144 is not formed.

The chamfered part 6 is tapered. An inner circumferential surface 145*a* of the orifice-body recess portion 145 is also tapered.

Next, as shown in FIG. 4, a surface on a side of the orifice body 14, on which the orifice-body recess portion 145 and the chamfered part 6 are formed, is polished such that the orifice-body sheet surface 144 is formed between the orifice-body recess portion 145 and the chamfered part 6.

An angle θ between the chamfered part 6 and the orifice-body sheet surface 144 is 30°. In other words, the chamfered part 6 is not a C-chamfered part, and is a tapered surface inclined at an angle other than 45° with respect to the orifice-body sheet surface 144. More specifically, the chamfered part 6 is a tapered surface inclined at an angle less than 45° with respect to the orifice-body sheet surface 144.

When a largest diameter of the chamfered part 6 is defined as D1, and a smallest diameter of the chambered part 6 is defined as D2, (D1−D2)/2 is defined as a chamfered dimension L. The chamfered dimension L may be set within a range from 0.005 to 0.04 millimeter.

After the orifice-body sheet surface 144 is formed by polishing, the coating layer 7 is formed on the orifice-body sheet surface 144 and the chamfered part 6, as shown in FIG. 2.

Next, operations of the above-described fuel injection valve will be described below. When a drive current is supplied to the solenoid 51, the armature 52 and the valve body 53 are attracted. Accordingly, the valve body 53 is separated from the orifice-body sheet surface 144, and the discharge passage 143 is opened.

Therefore, the fuel in the control room 125 is returned to the fuel tank through the discharge passage 143 and the actuator room 141. As a result, a pressure in the control room 125 is reduced, and a force urging the nozzle needle 2 through the command piston 4 in the valve closing direction decreases. The nozzle needle 2 is driven in the valve opening direction by a pressure of the fuel acting on the pressure receiving portion 23. Accordingly, the nozzle-needle sheet portion 21 is separated from the nozzle-body sheet portion 103, and thereby the injection hole 102 is opened. The fuel is injected from the injection hole 102 into the combustion chamber of the internal combustion engine.

The chamfered part 6 is provided on the corner part of the orifice-body sheet surface 144 and the discharge passage 143. Thus, a flow of the fuel adjacent to the corner part in which the orifice-body sheet surface 144 intersects with the discharge passage 143 changes its flow direction gently as shown by an arrow A of FIG. 2. Therefore, a fluid abrasive action force acted on the corner part in which the orifice-body sheet surface 144 intersects with the discharge passage 143 becomes small.

Figure 5:
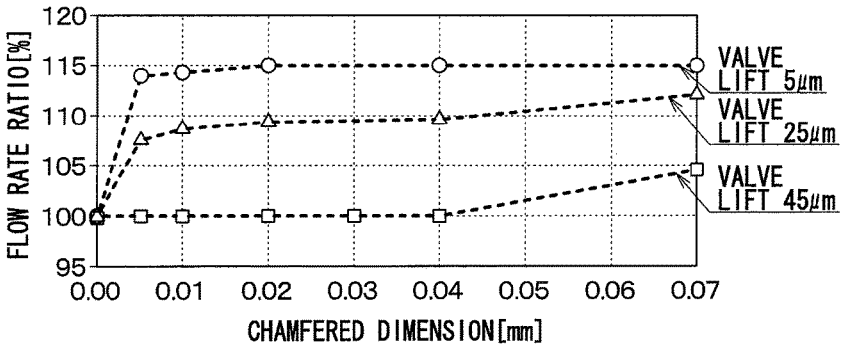
FIG. 5 is a diagram showing a flow-rate characteristic of discharged fuel with respect to a chamfered dimension or an R-dimension of a chamfered part.

FIG. 5 shows characteristics of flow rates (referred to as a discharged-fuel flow rate) of discharged fuel passing through the discharge passage 143 with respect to the chamfered dimension L. The vertical axis of FIG. 5 shows a flow rate ratio Rq of a discharged-fuel flow rate Q2 in the fuel injection valve that includes the chamfered part 6 to a discharged-fuel flow rate Q1 in a fuel injection valve that does not include the chamfered part 6, i.e. Rq=Q2/Q1×100.

The discharged-fuel flow rates Q1 and Q2 are calculated under conditions where a pressure of the high-pressure fuel accumulated in the common rail is 200 MPa, and a valve lift that is a gap size between the valve body 53 and the orifice-body sheet surface 144 is 5 μm, 25 μm, and 45 μm. From the calculated discharged-fuel flow rates Q1 and Q2, the flow rate ratio Rq is obtained.

As is clear from FIG. 5, when the chamfered dimension L is larger than or equal to 0.005 millimeter, a variation of the flow rate ratio Rq is small, and the discharged-fuel flow rate Q2 stabilizes. When the discharged-fuel flow rate Q2 stabilizes, a valve-opening responsiveness of the fuel injection valve stabilizes. However, when the valve lift is 5 μm or 25 μm and the chamfered dimension L is larger than 0.04 millimeter, the flow rate ratio Rq tends to increase gradually and moderately with increase in chamfered dimension L. Therefore, the chamfered dimension L may be larger than or equal to 0.005 millimeter. More specifically, the chambered dimension L may be set within a range from 0.005 to 0.04 millimeter.

When the supply of the drive current to the solenoid 51 is stopped, the attraction force dissipates, and the armature 52 and the valve body 53 are urged by the valve spring 54. Accordingly, the valve body 53 contacts the orifice-body sheet surface 144, thereby closing the discharge passage 143.

Thus, the pressure in the control room 125 increases due to the high-pressure fuel supplied through the introduction passages 127 and 142, and a force urging the nozzle needle 2 through the command piston 4 in the valve closing direction becomes large. Hence, the nozzle needle 2 is driven in the valve closing direction, and the nozzle-needle sheet portion 21 contacts the nozzle-body sheet portion 103 and closes the injection hole 102. Accordingly, fuel injection is stopped.

The chamfered part 6 is provided in the corner part where the orifice-body sheet surface 144 intersects with the discharge passage 143. When the valve body 53 contacts the orifice-body sheet surface 144 upon stopping supply of the drive current to the solenoid 51, a foreign object may be stuck between the valve body 53 and the orifice-body sheet surface 144. However, even when the foreign object is stuck therebetween, the corner part where the orifice-body sheet surface 144 intersects with the discharge passage 143 is unlikely to be deformed toward the discharge passage 143 because of the chamfered part 6. Accordingly, a crack is unlikely to be generated on the corner part.

As described above, according to the present embodiment, since the chamfered part 6 is provided in the corner part where the orifice-body sheet surface 144 intersects with the discharge passage 143, generation of cracks caused by the foreign objects can be limited, and the fluid abrasive action force can be reduced.

Figure 6:
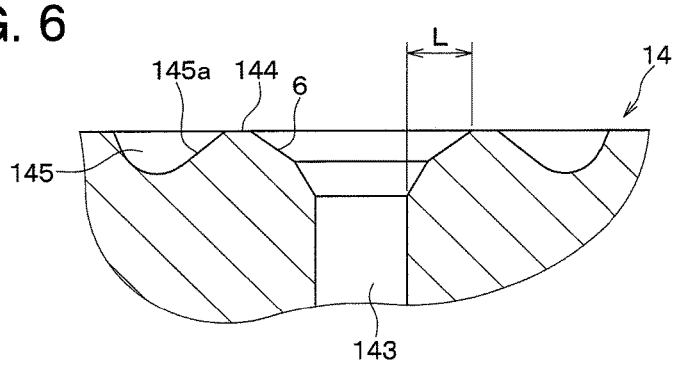
FIG. 6 is a sectional diagram showing an orifice body according to a first modification of the first embodiment.

In the above-described embodiment, the chamfered part 6 is constituted by a single tapered surface, but, as shown in a first modification of FIG. 6, the chambered part 6 may include two tapered surfaces.

Figure 7:
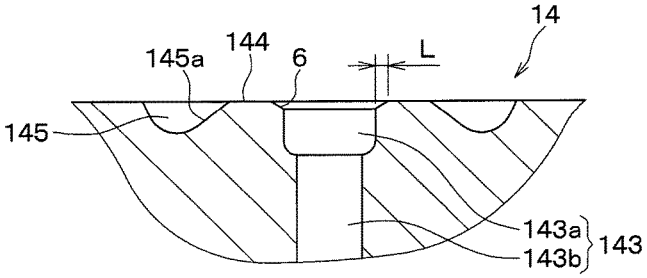
FIG. 7 is a sectional diagram showing an orifice body according to a second modification of the first embodiment.

In the above-described embodiment, the diameter of the discharge passage 143 is constant along the axial direction of the discharge passage 143, but, as shown in a second modification of FIG. 7, the discharge passage 143 may include a counterbore part 143*a* on an outlet end, and a small-diameter discharge path 143*b* that is smaller than the counterbore part 143*a* in diameter.

Figure 8:
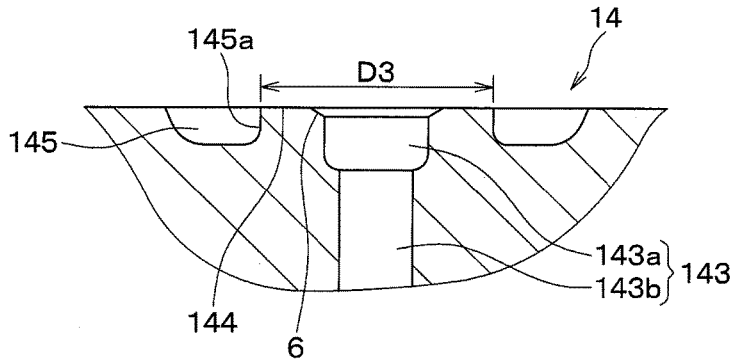
FIG. 8 is a sectional diagram showing an orifice body according to a third modification of the first embodiment.

In the above-described embodiment, the inner circumferential surface 145*a* of the orifice-body recess portion 145 is tapered, but, as shown in a third modification of FIG. 8, the inner circumferential surface 145*a* of the orifice-body recess portion 145 may be a surface perpendicular to the orifice-body sheet surface 144.

Accordingly, a processing accuracy in inner diameter D3 of the orifice-body recess portion 145 can be improved, and a variation in area of the orifice-body sheet surface 144 can be reduced.

Second Embodiment

A second embodiment will be described referring to FIG. 9. In the second embodiment, a different point from the first embodiment is that the configuration of the chamfered part 6 is changed. In the present embodiment, descriptions of parts similar or equivalent to the parts of the first embodiment will be omitted or simplified.

Figure 9:
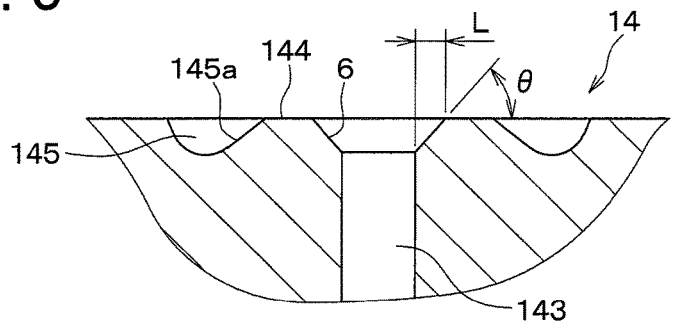
FIG. 9 is a sectional diagram showing a part of a fuel injection valve according to a second embodiment of the present disclosure.

As shown in FIG. 9, a chamfered part 6 has been treated with so-called C-chamfering such that an angle θ between the chamfered part 6 and an orifice-body sheet surface 144 is 45°. In other words, the chamfered part 6 is a C-chamfered part. Also in this case, a relationship between a chamfered dimension L and a flow rate ratio Rq is similar to that shown in FIG. 5. Therefore, the chamfered dimension L may be larger than or equal to 0.005 millimeter, i.e. the C-chamfered part may have C0.005 millimeter or more. Further, the chamfered dimension L may be set within a range from 0.005 to 0.04 millimeter, i.e. the C-chamfered part may have from C0.005 millimeter to C0.04 millimeter.

According to the present embodiment, similar effects to the first embodiment can be obtained.

Third Embodiment

A third embodiment will be described referring to FIG. 10. In the third embodiment, a different point from the first embodiment is that the configuration of the chamfered part 6 is changed. In the present embodiment, descriptions of parts similar or equivalent to the parts of the first embodiment will be omitted or simplified.

Figure 10:
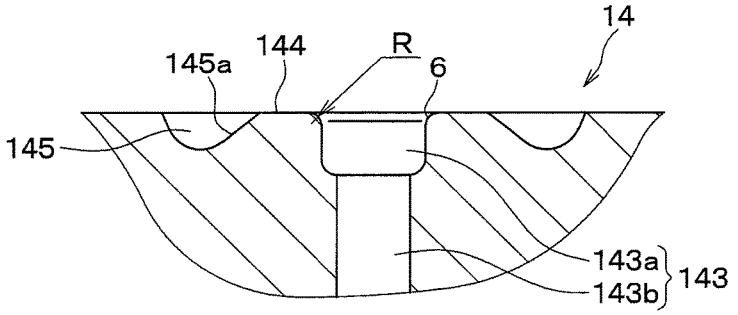
FIG. 10 is a sectional diagram showing a part of a fuel injection valve according to a third embodiment of the present disclosure.

As shown in FIG. 10, the chamfered part 6 has been treated with so-called R-chamfering such that the chamfered part 6 has an arc shape in cross-sectional surface along the axial direction of a discharge passage 143. In other words, the chamfered part 6 is an R-chamfered part. Also in this case, a relationship between an R-dimension corresponding to the above-described chamfered dimension L and a flow rate ratio Rq is similar to that shown in FIG. 5. Therefore, the R-dimension may be larger than or equal to 0.005 millimeter, i.e. the R-chamfered part may have R0.005 millimeter or more. Further, the R-dimension may be set within a range from 0.005 to 0.04 millimeter, i.e. the R-chamfered part may have from R0.005 millimeter to R0.04 millimeter.

The discharge passage 143 includes a counterbore part 143*a* on an outlet end, and a small-diameter discharge path 143*b* that is smaller than the counterbore part 143*a* in diameter.

According to the present embodiment, similar effects to the first embodiment can be obtained.

According to the third embodiment, the cross-sectional shape of the chamfered part 6 arcs, but the chamfered part 6 may have a curved shape other than the arc shape in cross-sectional surface along the axial direction of the discharge passage 143. More specifically, when a dimension of the chamfered part 6 having the curved cross-sectional shape in a radial direction of the discharge passage 143 is defined as a radial chamfered dimension L1, and a dimension of the chamfered part 6 in the axial direction of the discharge passage 143 is defined as an axial chamfered dimension L2, the radial chamfered dimension L1 is different from the axial chamfered dimension L2. Further, the radial chamfered dimension L1 may be larger than or equal to 0.005 millimeter. The radial chamfered dimension L1 may be set within a range from 0.005 to 0.04 millimeter.

The present disclosure is not limited to the above-described embodiments, and can be modified arbitrarily within a scope of the present disclosure.

The above-described embodiments are not unrelated to each other, and can be combined with each other unless the combination of embodiments is obviously impossible.

In the above-described embodiments, an element of each embodiment is not necessarily required unless the element is clearly described as particularly essential or the element is essential in principle.

In the above-described embodiments, when a specific number, such as value, amount, or range, of the element is mentioned, a number of the element is not limited to the specific number unless the number is clearly described as particularly essential or the number is limited to the specific number in principle.

In the above-described embodiments, when a shape or position of the element is mentioned, the shape or position of the element is not limited unless the shape or position is clearly described as particularly essential or the shape or position is essential in principle.

Additional advantages and modifications will readily occur to those skilled in the art. The disclosure in its broader terms is therefore not limited to the specific details, representative apparatus, and illustrative examples shown and described.

What is claimed is:

1. A fuel injection valve comprising:

a nozzle needle that opens or closes an injection hole through which a fuel is injected into an internal combustion engine;

a control room into which a high-pressure fuel is introduced to urge the nozzle needle in a valve closing direction;

an orifice body including a discharge passage through which the fuel is discharged from the control room to a low pressure portion, and a flat orifice-body surface that surrounds a downstream end part of the discharge passage;

a valve body that contacts with or separates from the flat orifice-body surface to close or open the discharge passage; and a chamfered part provided on a corner part in which the flat orifice-body surface intersects with the discharge passage, wherein the valve body includes a flat valve-body surface that contacts with or separates from the flat orifice-body surface without contacting the chamfered part, and the fuel injection valve further comprises a coating that is superior to the orifice body in abrasion resistance, the coating being on the chamfered part and the flat orifice-body surface and extending continuously from the chamfered part to the flat orifice-body surface.

2. The fuel injection valve according to claim 1, wherein the chamfered part is a tapered surface inclined at an angle other than 45° with respect to the flat orifice-body surface.

3. The fuel injection valve according to claim 2, wherein a largest diameter of the chamfered part is defined as D1, a smallest diameter of the chamfered part is defined as D2, (D1−D2)/2 is defined as a chamfered dimension L, and the chamfered dimension L is larger than or equal to 0.005 millimeter.

4. The fuel injection valve according to claim 3, wherein the chamfered dimension L is smaller than or equal to 0.04 millimeter.

5. The fuel injection valve according to claim 1, wherein the chamfered part is a C-chamfered part having C0.005 millimeter or more.

6. The fuel injection valve according to claim 5, wherein the C-chamfered part has C0.04 millimeter or less.

7. The fuel injection valve according to claim 1, wherein the chamfered part is an R-chamfered part having R0.005 millimeter or more.

8. The fuel injection valve according to claim 7, wherein the R-chamfered part has R0.04 millimeter or less.

9. The fuel injection valve according to claim 1, wherein a dimension of the chamfered part in a radial direction of the discharge passage is defined as a radial chamfered dimension, a dimension of the chamfered part in an axial direction of the discharge passage is defined as an axial chamfered dimension, the chamfered part has a curved line on a cross-sectional surface including an axis line of the discharge passage, and the radial chamfered dimension is different from the axial chamfered dimension.

10. The fuel injection valve according to claim 9, wherein the radial chamfered dimension is larger than or equal to 0.005 millimeter.

11. The fuel injection valve according to claim 10, wherein the radial chamfered dimension is smaller than or equal to 0.04 millimeter.

12. The fuel injection valve according to claim 1, wherein the chamfered part is a surface connecting the flat orifice-body surface and an inner surface of the discharge passage.

13. The fuel injection valve according to claim 1, the chamfered part surrounds the downstream end part of the discharge passage continuously and entirely.

14. The fuel injection valve according to claim 1, wherein the flat valve-body surface is perpendicular to an axial direction of the discharge passage.

15. The fuel injection valve according to claim 1, wherein the orifice body includes a recess portion that is recessed from the flat orifice-body surface and that has an annular shape surrounding the downstream end part of the discharge passage, and the recess portion has an inner circumferential surface which extends from an inner circumference of the recess portion and is oblique to the flat orifice-body surface.

16. The fuel injection valve according to claim 15, wherein a bottom surface of the recess portion is curved.

* * * * *